US005139412A

United States Patent [19]

Kychakoff et al.

[11] Patent Number: 5,139,412

[45] Date of Patent: Aug. 18, 1992

[54] METHOD AND APPARATUS FOR PROFILING THE BED OF A FURNACE

[75] Inventors: George Kychakoff, Maple Valley; Stephen R. Anderson, Kent; Alazel A. Acheson, Tacoma, all of Wash.

[73] Assignee: Weyerhaeuser Company, Tacoma, Wash.

[21] Appl. No.: 521,077

[22] Filed: May 8, 1990

[51] Int. Cl.[5] ..... H04N 7/18

[52] U.S. Cl. ..... 431/12; 431/13; 431/75; 431/10; 358/113; 110/186; 162/31; 374/124; 374/137; 356/376; 356/379

[58] Field of Search ..... 431/12, 79, 13, 10, 431/8, 7, 170, 75; 110/185, 186, 187; 162/30.1, 30.11, 31; 374/124, 137; 358/100, 107, 108, 113; 356/376, 379, 380

[56] References Cited

U.S. PATENT DOCUMENTS

| | | | |
|---|---|---|---|
| 3,477,823 | 11/1969 | Freiday | 358/100 X |
| 3,830,969 | 8/1974 | Hofstein . | |
| 4,463,437 | 7/1984 | Schenck et al. | 374/137 X |
| 4,539,588 | 9/1985 | Ariessohn et al. . | |
| 4,620,491 | 11/1986 | Nishikawa et al. | 431/79 X |
| 4,628,465 | 12/1986 | Ito et al. | 431/79 X |
| 4,690,634 | 9/1987 | Herngren et al. . | |
| 4,737,844 | 4/1988 | Kohola et al. . | |
| 4,737,917 | 4/1988 | Perron | 374/137 X |
| 4,814,868 | 3/1989 | James . | |
| 4,857,282 | 8/1989 | Mullen | 162/30.11 X |

FOREIGN PATENT DOCUMENTS

| | | | |
|---|---|---|---|
| 0084917 | 5/1982 | Japan | 110/185 |
| 0001919 | 1/1984 | Japan | 110/186 |
| 2029828 | 2/1987 | Japan | 374/124 |

*Primary Examiner*—Carl D. Price

*Attorney, Agent, or Firm*—Klarquist, Sparkman, Campbell, Leigh & Whinston

[57] ABSTRACT

A method and apparatus for profiling the bed of a furnace involves the production of a digital image of the bed and background. The digital image is processed to determine transitions in the image which correspond to transitions between the bed and background and thereby to the boundary of the bed. Bed characteristics, such as the bed profile, the bed height, the slope of the bed and the volume of the bed are determined from the processed image. The image may be displayed for use in controlling the performance of a furnace. In addition, the determined bed characteristics may be compared with reference bed characteristics, with the differences being displayed, used in controlling the operation of the furnace, or in activating an indicator, such as an alarm, in the event the reference and determined bed characteristics differ by a threshold amount.

15 Claims, 9 Drawing Sheets

METHOD AND APPARATUS FOR PROFILING THE BED OF A FURNACE

BACKGROUND OF THE INVENTION

The present invention relates to the determination of the profile of a bed of a furnace, such as the smelt bed of a boiler. Secondarily, the present invention relates to displaying information concerning the bed profile and to utilizing this information in the control of the furnace.

The monitoring of a hot infrared emitting surface or bed obscured by particulate fume and hot gases, such as found in Kraft pulp recovery boilers is a difficult task. That is, interference from fume particles and gaseous radiation within the furnace tends to obscure the view of hot surfaces, such as of the smelt bed, under such adverse environmental conditions.

U.S. Pat. No. 4,539,588 to Ariessohn, et al. describes one form of an apparatus for this purpose. In particular, the Ariessohn, et al. device comprises a closed circuit video camera fitted with an infrared imaging detector or vidicon tube. An objective lens obtains the image. An optical filter interposed between the lens and vidicon is selected to reject radiation in all but limited ranges of radiation to avoid interference by gaseous species overlaying the smelt bed, such gases being strongly emitting and absorbing. As a specific example, a spectral filter centered at 1.65 micrometers with a band width of 0.3 micrometers is suitable for imaging a Kraft recovery smelt bed.

A product known as TIPS TM from the Sensor and Simulator Products division of Weyerhaeuser Company of Tacoma, Wash. incorporates the device of the Ariessohn, et al. patent in a temperature image processing and storage system. The TIPS system creates digitally colorized images of the smelt bed for use by an operator. In the TIPS system, due to the partial elimination of the affects of moving particles in the image, the view of active scenes on the bed is permitted. The TIPS system is especially designed for displaying temperature trends of the bed on digital and graphic displays and for tracking changes from a reference temperature at a selective location in the process, or to observe temperature differences between locations. In addition, the TIPS system allows the production and storage of historical temperature changes. Moreover, the TIPS system permits the manual adjustment of a reference temperature for purposes of comparison.

The capabilities of the TIPS system are described in greater detail in an article published in April of 1989 entitled "Monitoring of Recovery Boiler Interiors Using Imaging Technology," by Anderson, et al (CPPA-TAPPI 1989 International Chemical Recovery Conference). In addition to discussing the imaging of a bed for purposes of developing temperature trend information, this particular article mentions that adequate smelt reduction requires sufficient bed residence time, which is influenced by bed configuration. The article also recites that both of these issues can be addressed by a bed level monitoring system which can extract the bed profile and alert the operator when the bed drifts out of the user-defined range. The article then mentions that the Weyerhaeuser (TIPS) system has the capability to detect bed heights so as to provide a control signal for those interested in using bed height or slope for control purposes. However, this article does not provide any information on how these goals would be accomplished.

U.S. Pat. No. 4,737,844 to Kohola, et al. describes a system utilizing a video camera for obtaining a video signal which is digitized and filtered temporally and spatially. The digitized video signal is divided into signal subareas with feature elements belonging to the same subarea being combined into continuous image areas corresponding to a certain signal level. The combined subareas are then processed to provide an integrated image which is averaged to eliminate the effect of random disturbances. The averaged image is displayed on a display device. The images may then be compared to optimum conditions. Areas corresponding to effective combustion and the flame front of a bed, are then defined using histograms, and identified by means of their area, point of gravity coordinates of the area and point-by-point recorded contours of the area. In addition, the contours of voids inside the area are defined. In an application described in the Kohola, et al. patent, the flame front, location and shape of the fuel bed is determined.

In Kohola, et al., the material to be burned is shown as a bed of a substantially identical thickness and width. This bed is delivered to the mill end of a boiler stoker where the flame front is concentrated. Thus, Kohola, et al. is described in conjunction with a bed of a substantially uniform contour and is not directed toward beds such as are found in smelt bed boilers which are burning throughout substantially their entire surface and wherein the contours of the bed vary depending upon furnace operating parameters, such as the fuel to air ratio.

Although systems exist for monitoring the interior of recovery boilers and other furnaces, a need exists for an improved system for determining the profile of the bed, such as of a smelt bed, in the interior of such furnaces. The determined profile may then be displayed or optionally used, for example, in the control of the operation of the furnace.

SUMMARY OF THE INVENTION

A method and apparatus for profiling the bed of a furnace surrounded by a background which may include walls of a furnace is disclosed. In accordance with the invention, a digital image of the bed and background is produced. The digital image is then processed to determine transitions in the image which correspond to transitions between the bed and background and thereby to the profile and boundary of the bed. At least one bed characteristic is determined from the processed image. The determined characteristic is selected from the group comprising the bed profile, the bed height, the slope of the bed and the volume of the bed. The determined characteristic may then be displayed or otherwise used, such as in the control of the parameters affecting the operation of the furnace.

In accordance with another aspect of the present invention, a reference bed characteristic is provided, such as interactively entered by a user or may be otherwise supplied depending upon the specifications for a given furnace. The determined bed characteristic may be compared with the reference bed characteristic to verify whether these determined and reference characteristics differ by, for example, a threshold amount. In the case of such a difference, an indicator may be activated to provide an indication to a furnace operator of the occurrence of these conditions. Alternatively, or in combination with such an indication, the parameters of the furnace may be automatically controlled to adjust the determined bed characteristic to more closely match the reference bed characteristic. In many cases, however, an indication of the occurrence of the difference is all that is required as an experienced boiler operator may then take responsive steps to address the cause of the difference. Many conventional furnaces and boilers have adjustment mechanisms for controlling the parameters affecting the performance of the furnace. For example, it is common for these furnaces to have controllable fuel and controllable combustion air supplies. By controlling the supply of fuel and air, for example, by adjusting the air to fuel ratio, the bed characteristics may be varied to bring the determined bed characteristic into a more close match or correspondence to the reference bed characteristic. The various determined and reference bed characteristics may be utilized individually or in combination with one another as desired.

As another aspect of the present invention, the determined bed characteristic may be stored to provide at least a partial history of such bed characteristic. In addition, the performance characteristics of the furnace, such as fuel efficiency, reduction efficiency and the like may be correlated, as by date and time, to the history of bed characteristics. By reviewing the history of the determined bed characteristics and determining which characteristics correspond to the optimum furnace performance, a target bed characteristic for optimum furnace performance may be determined for a particular furnace. The furnace may then be operated using such a target bed characteristic with the furnace being controlled to provide a determined bed characteristic which matches the target bed characteristic.

As a more specific aspect of the present invention, plural digital images of the bed and background may be provided. These images are then processed to determine transitions corresponding to transitions between the bed and background and thereby to the boundary of the bed. A multiple step processing approach and apparatus may be used in the processing of these images. This processing approach may comprise the steps of selecting images from the plural digital images for clarity; temporally averaging the selected images; differentiating the images following temporal averaging; smoothing the images; and thereafter locating transitions in the images. More specifically, the step of locating the transitions may include the performance of a continuity check which involves the selection of transitions which yield a substantially continuous or smooth determined bed profile. In addition, a region growing process may also be used in determining the transitions. The continuity check and region growing processes may be performed individually or in combination with one another to the locate the bed profile transitions.

Assuming that the characteristic of interest is the bed volume, a two-dimensional digital image of the bed and profile may be obtained from a view of the bed taken in first direction. The volume of the bed may then be computed utilizing a circular or other approximation for the configuration of the bed. In another approach, digital images of the bed and profile may be taken from first and second directions with the directions being at an angle relative to one another. In this case, the bed volume may be computed utilizing an elliptical or other approximation for the configuration of the bed.

An imaging means is disposed proximate to the region of the bed to be monitored for producing an image signal corresponding to the image of the monitored portion of the bed and background. Any suitable imaging means may be used for producing the desired image, such as a video camera with a vidicon tube and infrared filter as described in the previously mentioned Ariessohn, et al. patent. The image is then digitized and processed as described above to provide information on the transition between the bed and background and thereby to the boundary or profile of the bed.

The invention includes the above features taken both individually and in combination with one another.

It is accordingly one object of the present invention to provide an improved apparatus for profiling the hot infrared radiation emitting surfaces of a furnace bed, particularly in situations where such surfaces are obscured by particulate fume and hot gases.

Still another object of the present invention is to determine a characteristic of such a bed, such as the bed profile, the bed height, the slope of the bed and the volume of the bed, for use in monitoring the performance of the furnace. This information may simply be displayed or may be used in controlling a furnace either automatically, or interactively in response to operator input as an operator views the determined information.

As still another object of the present invention, target bed characteristics may be entered and used in a comparison with the determined bed characteristics for an evaluation of the performance of the furnace and, optionally, in controlling of furnace operation.

These and other objects, features, and advantages of the present invention will become apparent with reference to the following description and drawings.

DETAILED DESCRIPTION OF PREFERRED EMBODIMENTS

The present invention will be described in connection with the application of monitoring the profile of a smelt bed of a recovery boiler. It should be noted, however, that the system is also applicable to imaging the profiles of other types of beds and in particular to beds of the type which emit infrared radiation in environments which are obscured by particulate fumes and hot gases. Also, for purposes of convenience, the present invention will be described in connection with an imaging system of the type described in the Ariessohn, et al. patent, although other imaging devices will be suitable depending in part upon the nature of the furnace environment. For example, an arrangement of photo diodes may be utilized for this purpose. Thus, any system suitable for monitoring the bed of a furnace and generating an image signal corresponding to the bed and walls or other background surrounding the bed may be used.

Figure 1:
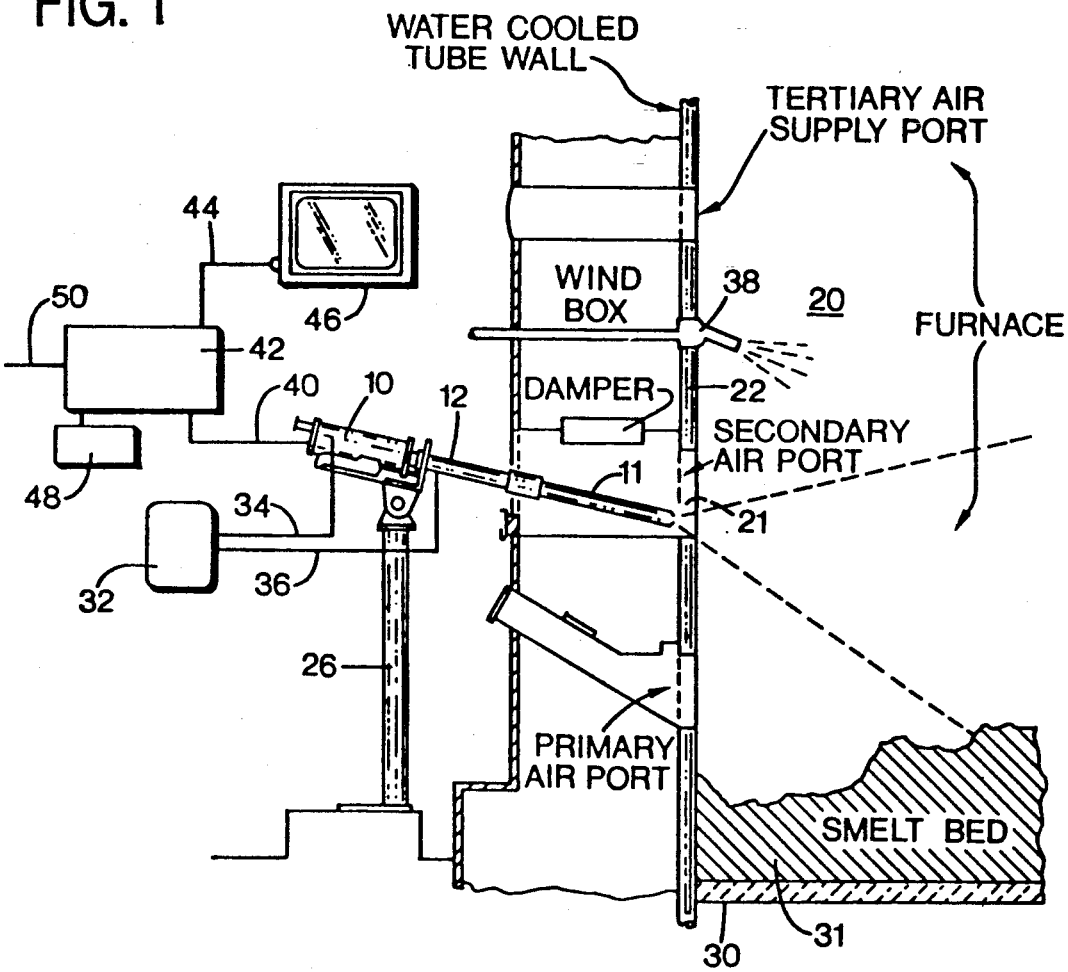
FIG. 1 is a schematic illustration of an imaging apparatus of the present invention for use in determining the profile of a furnace bed, in this case shown in combination with a chemical recovery boiler and smelt bed.
Figure 2:
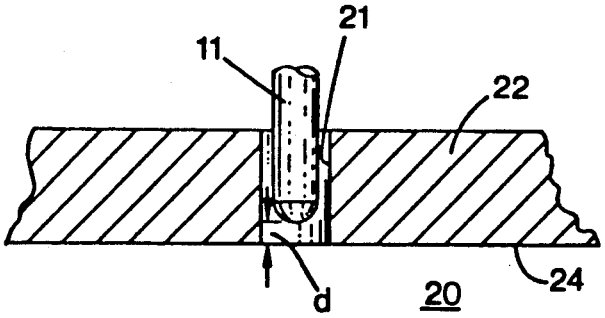
FIG. 2 is a cross sectional view through a portion of a wall of the furnace of FIG. 1 illustrating the positioning of an imaging apparatus within a port extending through the furnace wall.

Referring to FIG. 1, a closed circuit television camera 10, which includes an infrared vidicon tube component (not shown in detail) is located adjacent a boiler 20 whose interior is to be imaged. A lens tube assembly 11, mounted upon camera 10, extends toward the boiler 20 through a port or aperture 21 in a boiler wall 22. As shown in FIG. 2, the lens tube assembly 11 is typically spaced a distance d from the interior surface 24 of the boiler wall 22. Typically the distance d is approximately about one-half to one inch so as to protect the tube assembly 11 from burning particles traveling within the furnace. The lens assembly 11 contains such objective, collecting and collimating lenses (not shown in detail) as are conventionally necessary to transmit an image to be remotely reproduced from the object to be observed to the infrared vidicon of camera 10. The camera 10 is mounted on a stand 26 which permits horizontal and vertical adjustment to view a substantial portion of the boiler floor 30 and a smelt bed 31 accumulated thereon. Typically the camera is directed so as to view the bed and a portion of the background walls behind the bed in the field of view of the camera. This background may equivalently include the gases and particulate matter above the bed in the event the furnace back wall is not visible.

An optical filter 12 is included in the camera system of FIG. 1 so as to limit the wavelength of light transmitted to the vidicon from the object to be imaged so as to minimize interferences caused by particulate and fumes overlaying the surface to be imaged. The optical filter 12 typically further limits the transmission of light from the surfaces to be imaged to a narrow band which avoids the light emissions of the principle species of hot gases overlaying the surface to be imaged. The selection of optical filters suitable for these purposes is described in greater detail in U.S. Pat. No. 4,539,588 to Ariessohn, et al. Filtered purging air from an air source 32 is delivered by way of lines 34 and 36 to the imaging sensor components for cooling purposes and for sweeping debris from the end of the tube assembly 11.

Typically the vidicon tube assembly 11 is positioned in an existing air supply port to the furnace, such as in the secondary air port 21 indicated in FIG. 1. Furnaces of this type also typically include primary air ports directed toward a lower portion of the furnace bed and tertiary air ports positioned above the secondary air ports. In addition, the supply of air to ports at these various levels and various locations about the periphery of the furnace may be manually controllable or may be controllable by a process controller or computer in a conventional manner. Thus, the supply of combustion air may be increased or decreased to substantially any location of the smelt bed to adjust the combustion occurring at such location. In addition, fuel, such as black liquor from a Kraft pulping operation, may be delivered in a conventional manner through plural nozzles, one being indicated at 38 in FIG. 1, to the furnace. These nozzles are typically positioned between the secondary and tertiary air supply ports. The supply of fuel is also typically controllable by the process computer or controller. In general, by controlling parameters, such as the combustion air to fuel ratio, the viscosity of the fuel, the direction of the fuel nozzles, and the like, the burning of fuel in the furnace may be controlled to optimize furnace efficiency, the reduction of chemicals in the furnace, and the throughput or capacity of the furnace. Information on such furnaces is readily available with three principle recovery boiler manufacturers being Combustion Engineering; Babcock and Wilcox; and Gotaverken. As is well known in the art, the smelt bed is formed of residue or solids which drop out of the black liquor and burn in the bed.

As in the case of the TIPS TM system from Weyerhaeuser Company, the image signal from the imaging sensor may be delivered on a line 40 to a imaging system 42 for signal processing. The processed signal may be fed by way of a line 44 to, for example, a display such as a television monitor 46 for display thereon and observation by an operator of the furnace. The imaging subsystem 42 also typically includes a user interface, indicated separately at 48 in FIG. 1. The interface typically comprises a keyboard which allows the furnace or boiler operator to input information into the imaging system. For example, the furnace operator enter a desired target bed profile.

As explained in greater detail below, the imaging system 42 produces a digital image of the bed and background from the image signal received by way of the line 40. The digital image is processed as explained in greater detail below to determine the transitions in the image which correspond to transitions between the bed and background and thereby to the boundary or profile of the bed. A bed characteristic may then be determined from the processed image. Examples of the bed characteristics of interest include the bed profile itself, the bed height, the slope of the bed, and the volume of the bed. The imaging system 42 may simply cause this information to be displayed on monitor 46. However, optionally, control signals representing the determined bed characteristics may be transmitted by way of a line 50 to the process computer of the furnace for use in directly controlling parameters, such as the fuel and air ratios, which affect the combustion of fuel in the bed and thus the bed characteristics. In addition, the operator of the furnace may, as a result of observing the determined characteristics displayed on monitor 46 or which are otherwise indicated to the operator, enter commands by way of keyboard 48. These commands result in control signals being sent on line 50 to the process computer for again controlling the parameters affecting the performance and bed characteristics of the furnace.

Figure 3:
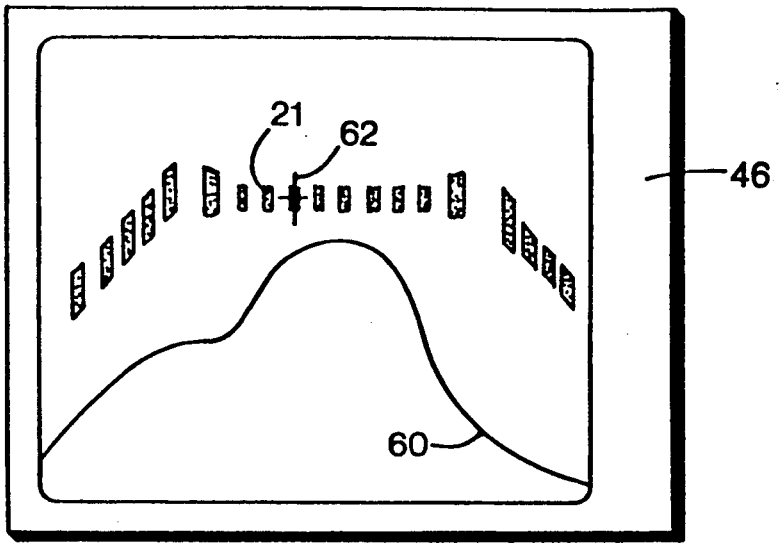
FIG. 3 is a display of a representative bed profile of a bed in a furnace.

With reference to FIG. 3, the monitor 46 is shown with a two-dimensional image of an actual bed profile 60 displayed thereon. The commercially available TIPS TM system is capable of producing video displays of bed profiles in this manner. Also shown in FIG. 3 is a reference pointer, such as a crosshair 62. Using the user input 48, the reference crosshair 62 may be shifted to overlay a fixed reference point in the furnace, such as one of the secondary air ports. Thus, when the image sensor 10 is in position, the bed monitoring is fixed relative to this reference. If at any time the crosshair is shifted from the reference, due to bumping or the like, the user of the device may readily observe this shift. The camera 10 may then be readjusted to its original position to again place the crosshair 62 over the original reference point in the furnace. Alternatively, the system may be recalibrated to a new reference point.

Figure 4:
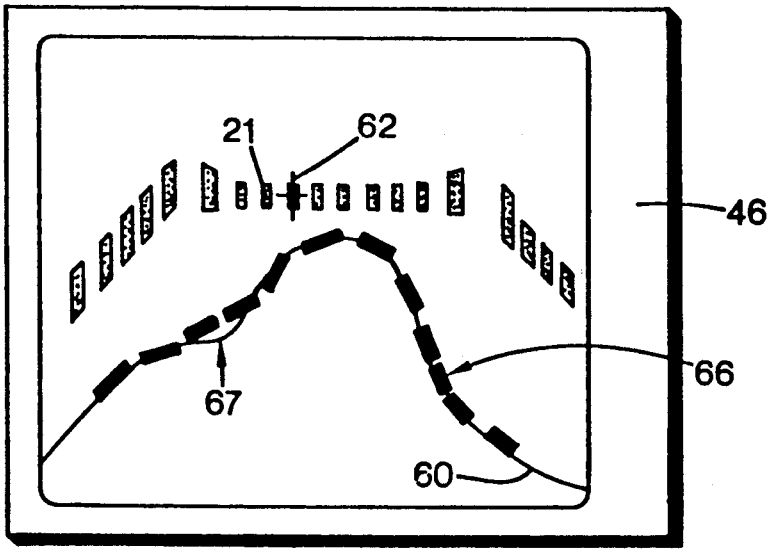
FIG. 4 is a display of the bed of FIG. 3 showing interposed on such bed a determined bed profile, determined in accordance with the apparatus and method of the present invention.

FIG. 4 illustrates a determined bed profile 66, in terms of a 12 line segment best fit, determined in accordance with the present invention. That is, as explained in greater detail below, the image produced by the imaging sensor 10 is digitized and processed to determine the transitions in the image corresponding to the bed profile with the determined bed profile 66 being generated as a result of this process. In this example, the determined bed profile 66 is displayed for view by the operator. It is a non-trivial task to determine the profile from the video image due to the nature of the image. That is, an image of a bed of a furnace has fuzzy, blurred or otherwise indistinct transitions between the bed and the background. To digitally extract the transition points which define the bed profile, image processing techniques are used with the system looking for the soft or blurred transitions occurring between the bed and background in these environmental conditions.

Due to the nature of the transitions between the bed profile and background, an inexact fit may exist between the determined profile and the actual bed profile as indicated at 67. However, these differences are minimized utilizing the image processing techniques explained below.

Figure 5:
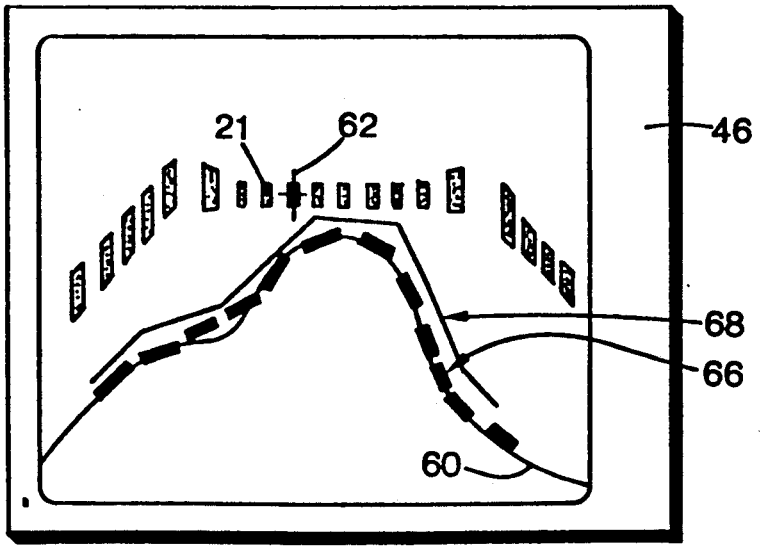
FIG. 5 is an illustration of the bed profile of FIG. 3 with the determined profile and a target profile shown overlayed thereon.

FIG. 5 illustrates the bed profile 60 with the superimposed determined bed profile 66 and still another profile 68 included therein. The profile 68 corresponds to a target bed profile which may be entered by a user of the system utilizing input interface 48 (FIG. 1). This target profile may be provided for a given furnace, such as by a boiler manufacturer as a result of observations of a furnace. In addition to, or instead of, a target profile, other target bed characteristics may also be entered. For example, target maximum and minimum bed height, volume and slope data may be entered for comparison to corresponding characteristics determined from the image by the system of the present invention.

Figure 6:
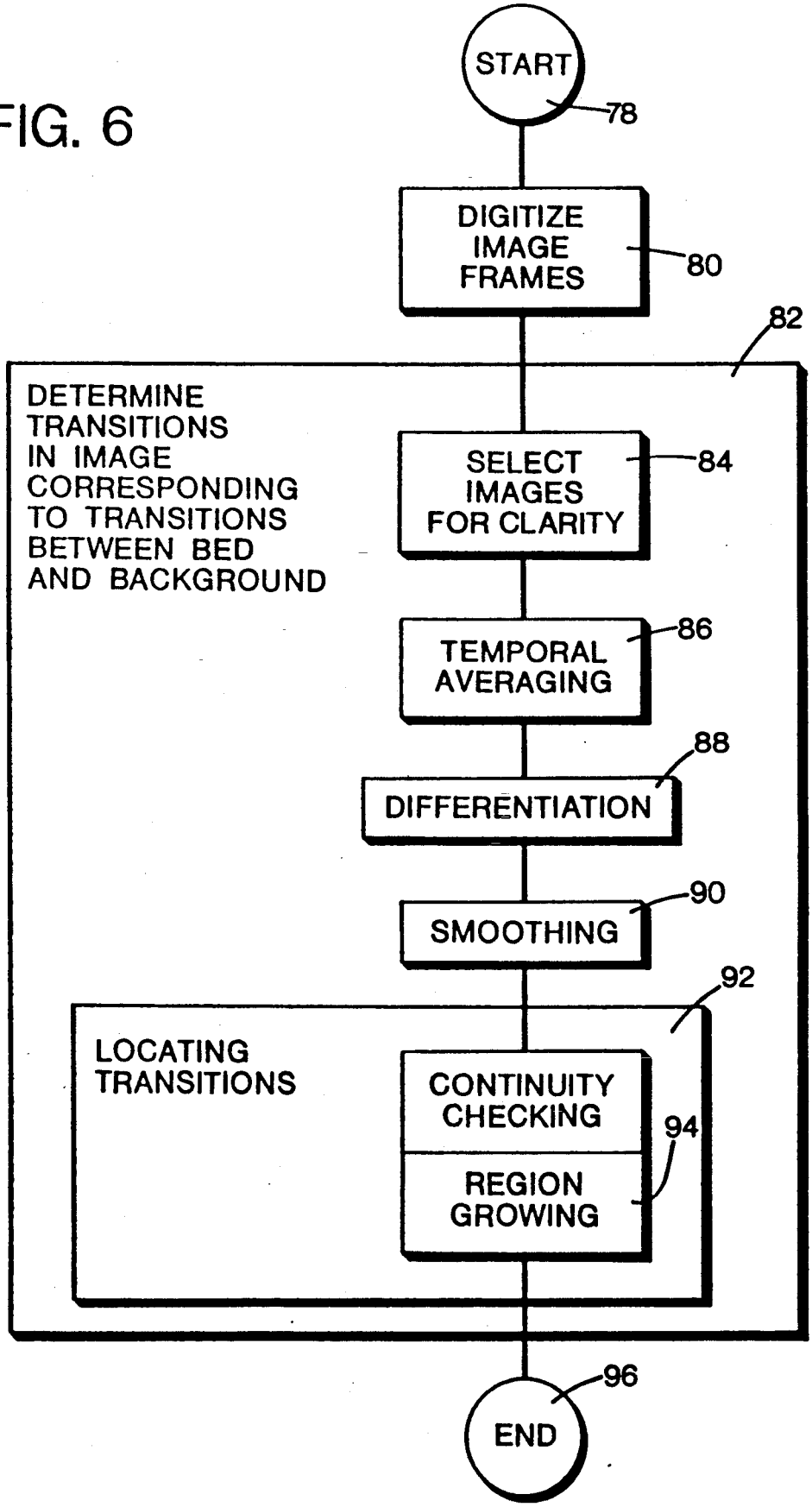
FIG. 6 is a flow chart illustrating one series of steps which may be utilized in accordance with the present invention to determine the bed profile of the bed being monitored.

With reference to FIG. 6, a preferred processing approach for determining the transitions between the background and bed, and thus the bed profile, is illustrated. From a start block 78, a block 80 is reached and corresponds to the digitization of image frames from the signal provided by image sensor 10. This process is accomplished in a conventional manner on a frame-by-frame basis by the imaging system 42 (FIG. 1).

The digitized image frames are then used in the determination of the transitions in the image corresponding to the transitions between the bed and background as indicated at block 82. More specifically, this step typically is a multi-step image processing approach indicated by subblocks 84, 86, 88, 90 and 92.

In accordance with a specific clarity selection approach at block 84, the images are selected based upon their standard deviation. First, a baseline standard deviation of intensities is calculated over a large number of images, along with the mean and the standard deviation of these values (that is, the mean and standard deviation of the standard deviations). Then, the images are monitored by the imaging system 42 and selected for further processing if the standard deviation of the image in question is larger than the sample average by one standard deviation. This provides an adaptive method for selecting relatively good images. Good images are those in which there is a high level of contrast in the intensities in the image. The image intensities vary for reasons such as flare ups in the bed, which may tend to obscure the boundary or profile of the bed. Typically, the block 84 process continues until eight images have been selected in this manner as having a clarity which is suitable for further processing. Of course, more or fewer images may be selected for processing as desired.

At block 86, a temporal averaging of the selected images is performed. That is, the selected images, in this case the eight images, are averaged pixel-by-pixel to filter out spurious and moving noise components. In a specific approach, the value of the pixel element at each location is summed with the other values of the pixel elements at the same location and the sum is then divided by the number of selected image frames to determine a temporal average.

Thereafter, the temporally averaged images are differentiated, as indicated at block 88, to identify changes in local pixel intensity. In a specific differentiation approach, these changes in local pixel intensity are identified using an edge-detection convolution which tends to favor horizontally oriented edges. The desired convolution is empirically derived for each type of boiler selecting and refining a convolution until a suitable convolution is obtained for the particular boiler type. That is, the derived profile is compared with actually observed profile with the convolution being modified until a satisfactory match is observed repeated tests. A convolution mask M for differentiation purposes which works well for a Gotaverken-type boiler is set forth below:

$$\begin{vmatrix} -3 & -4 & -3 \\ -1 & -4 & -1 \\ 0 & 0 & 0 \\ 1 & 4 & 1 \\ 3 & 4 & 3 \end{vmatrix} = |M|$$

This convolution mask is applied to the pixels to obtain the differentiating image.

For example, to compute a new value for a pixel X8, one would apply the convolution mask above to the pixels surrounding pixel X8 in a conventional manner as expressed below.

$$\text{New } X8 = \begin{vmatrix} X1 & X2 & X3 \\ X4 & X6 & X6 \\ X7 & X8 & X9 \\ X10 & X11 & X12 \\ X13 & X14 & X15 \end{vmatrix} \times |M|$$

In the above expression, M stands for the convolution mask such as set forth above.

Because differentiation tends to amplify noise and create local spurious edge artifacts, a smoothing or blurring process is utilized at block 90 to effectively remove small artifacts by averaging them with adjoining pixels. One specific smoothing approach involves an application of a smoothing convolution with a Gaussian kernel to the pixels.

Following the smoothing of the image, the transitions are then located as indicated at block 92. Several approaches may be utilized either alone or in combination with one another to locate these transitions. For example, continuity checking techniques may be applied and/or region growing techniques may be applied to locate the transitions. These steps are indicated at Block 94 within the Block 92.

The result of the differentiation is that pixels residing near edges become bright. If the back wall is not visible in an image, there tend to be more features which resemble edges in the bed than behind it. Conversely, where the back wall is of a greater visibility, more of the edges tend to be visible at the regions of the transitions between the bed and back wall.

A primary edge point or starting point for the profile may be determined by starting at the bottom of the image and looking for relatively bright pixels. Once a pixel is found with the highest position in the vertical direction that is relatively bright (relative to the other pixels in that vertical line), it is marked as the starting point.

Continuity is then enforced by, for example, a continuity checking technique. In accordance with this technique, for each edge element in question, continuity is check for continuous edge elements to the right and to the left. If there are continuous pixels (that is of a common intensity), indicating the probability of an edge, the pixel in question is forced to be near the mid-point between the left and right pixel segments. This process of continuity checking is performed recursively, and the result is that errors in the edge element selection process tend to be corrected. Thus, the continuity process involves imposing continuity on the determined profile and alternatively continuing this process to find the best fit of the pixels to a continuous profile from the starting pixel.

To further enhance the appearance of the determined profile, a subsequent smoothing or region growing process may be applied following the continuity checking or enforcement process. In accordance with the region growing approach, from a starting point, the mean and standard deviation is computed. The next point is then examined and evaluated to determine whether its intensity is close enough to the previous point to be part of the region. If so, it is included in the region and the mean and standard deviation is recomputed. This process is continued until a point can no longer be included in the region. This latter point is then identified and corresponds to an edge point of the bed profile. Typically the region growing technique commences at a location which will be either above or below the bed profile with the region then being grown by adding pixels in the direction of the expected bed profile until a nonfitting point is identified.

The continuity imposition and region growing processes may be performed individually, but preferably collectively, to provide an enhanced determination of the bed profile. From block 92, the bed profile has been determined and the block 96 is reached.

Figure 7:
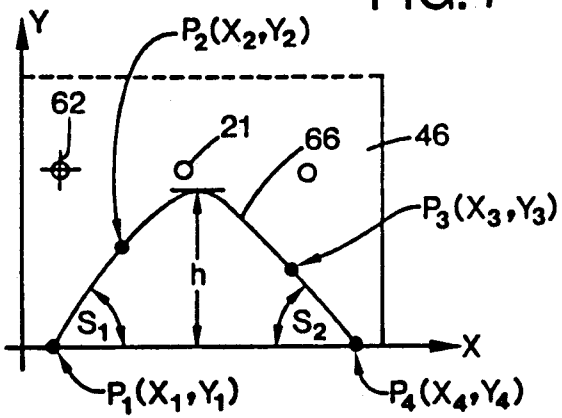
FIG. 7 is a schematic illustration of the field of view of a bed being monitored by an imaging apparatus to schematically show a determined bed profile and certain characteristics of the bed profile.

FIG. 7 illustrates a determined bed profile 66 which may be displayed on the monitor 46 (FIG. 1) for observation by the operator of the furnace. From the profile, a number of bed characteristics can be determined, such as the bed height indicated at h in FIG. 7. In addition, the bed volume may be computed from this profile, such as explained below. Furthermore, a slope at various locations along the bed profile may also be determined. For example, the left hand slopes S1 may be determined by fitting a straight line to the profile points $(X_1, Y_1)$ and $(X_2, Y_2)$. As a simplified example, assume that there are no profile points between points $P_1$ and $P_2$ and between points $P_3$ and $P_4$. In this case, a (cartesian or (X, Y) coordinate system may be imposed on the field of view or display of the monitor 46. Respective points P1, P2, P3 and P4 (along with other points) may be identified by their respective X and Y coordinates along the bed profile. Slopes can then be determined in a conventional manner. For example, the slope at S1 may be determined as follows:

$$S1 = \frac{(Y_2 - Y_1)}{(X_2 - X_1)}$$

Similarly, the slope S2 may be determined as follows:

$$S2 = \frac{(Y_4 - Y_3)}{(X_4 - X_3)}$$

Figure 8:
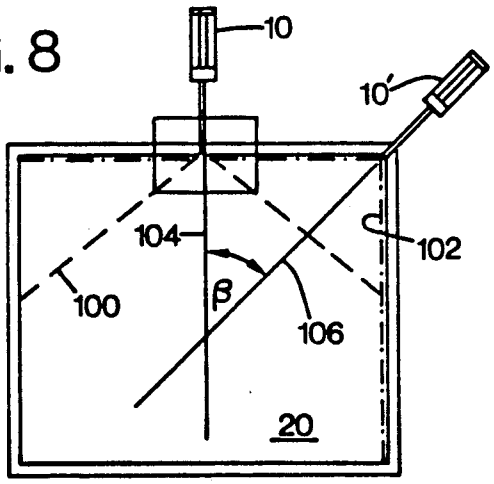
FIG. 8 is a top plan view of a section of a furnace with two imaging sensors shown therein for obtaining different fields of view of the bed in the furnace.

FIG. 8 illustrates a top plan view of the boiler 20 with two imaging sensors 10, 10' illustrated in this figure. The first imaging sensor 10 has a field of view indicated by dashed lines 100 while the second imaging sensor 10' has a field of view indicated by the dashed and dotted lines 102. Imaging sensor 10 is thus directed along a line 104 bisecting its field of view while imaging sensor 10' is thus directed along a line 106 which bisects its field of view. The lines 104 and 106 intersect at an angle B. The two imaging sensors may be utilized in connection with computing the volume of the bed as explained below. In general, for operations in which the boiler interior is substantially opaque due to fumes and particulate matter, the angle B is increased from an acute angle to an obtuse angle and may be set at a substantial angle such that the two lines 104 and 106 being are approximately orthogonal to one another. The resulting image information provides an improved and more accurate basis for determining of the volume of the bed.

Figure 9:
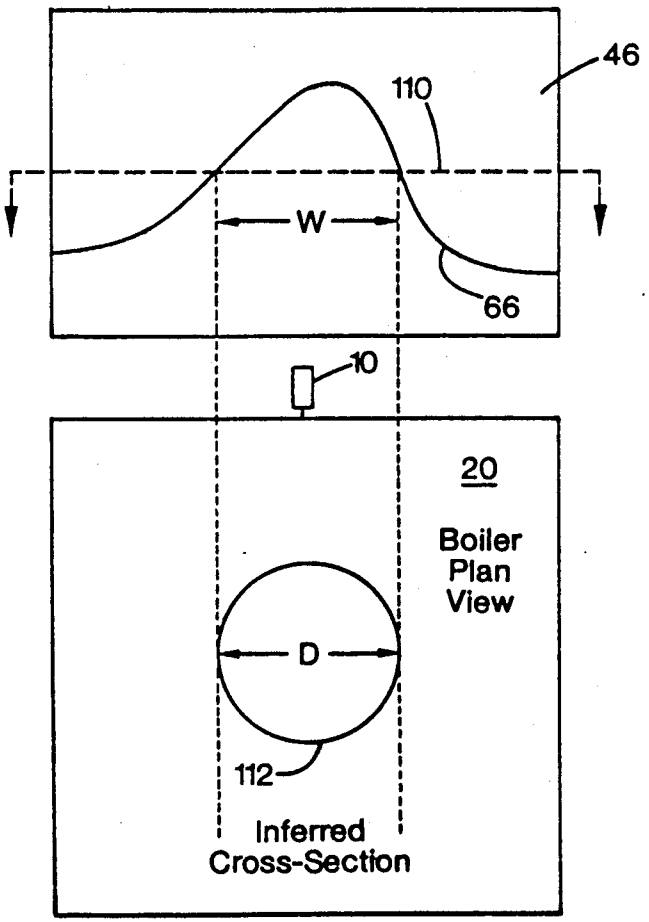
FIG. 9 is a schematic illustration of a determined bed profile obtained by using the image from one of the imaging sensors of FIG. 8 and further illustrating a circular approximation technique for determining the bed volume from the determined bed profile.

With reference to FIG. 9, a single imaging sensor 10 is shown and is used as explained above to produce a determined bed profile 66. Using a circular or other approximation for the contour of the bed, the smelt bed volume may be estimated or computed from the profile. That is, one can infer that a slice across the bed, for example, in a horizontal plane 110 as indicated in FIG. 9, yields a circular cross-section as indicated at 112 in FIG. 9. The inferred diameter D of the cross-section 112 is obtained from the width W of the determined bed profile at the vertical height of the horizontal plane 110. By integrating the profile, that is by assuming the profile defines a bed of circular rings stacked on one another, a bed volume may be computed.

Figure 10:
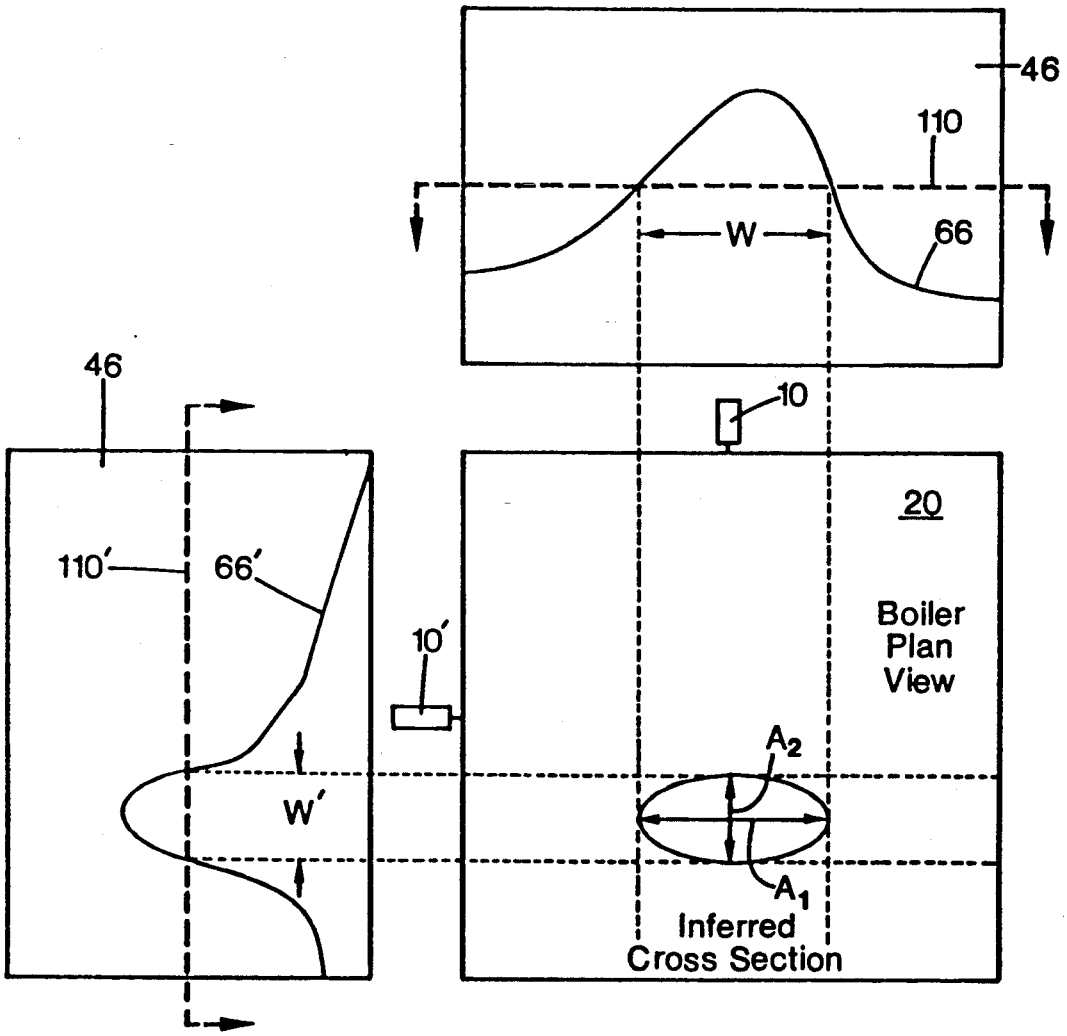
FIG. 10 is a schematic illustration of first and second determined bed profiles obtained by using the images from first and second imaging sensors of FIG. 8 and also illustrating an elliptical approximation technique for determining the bed volume from these determined bed profiles.

In FIG. 10, another approach for computing bed volume is illustrated wherein plural, in this case two, imaging sensors are utilized. That is, in FIG. 10, first and second imaging sensors 10, 10' are arranged as shown so as to be focused in directions orthogonal to one another. That is, referring again to FIG. 8, if one were to draw the lines 104 and 106 shown in FIG. 8, the angle B would be 90°. In this case, from camera 10, as explained previously in connection with FIG. 9, an inferred width W of the bed in a first direction is obtained and is indicated by axis A in FIG. 10. Similarly, the imaging sensor 10' produces a determined profile 66' from the view of the bed taken in the direction as shown in this figure. In a plane corresponding to 110, namely plane 110', a width W' is determined from the derived profile 66'. The inferred cross-section of the bed in this direction is indicated as axis $A_2$ in FIG. 10. Using an elliptical approximation for the bed, that is assuming A1 corresponds to the length of an axis of an ellipse in a first direction and that $A_2$ corresponds to the length of an axis of an ellipse in the second direction, one can infer that the bed has an elliptical cross section. Integrating the bed over its height and assuming an elliptical profile, a computed bed volume may be obtained. Since beds are not necessarily symmetrical, a bed volume approximation utilizing plural image sensors will result in a more accurate bed volume computation.

Figure 11:
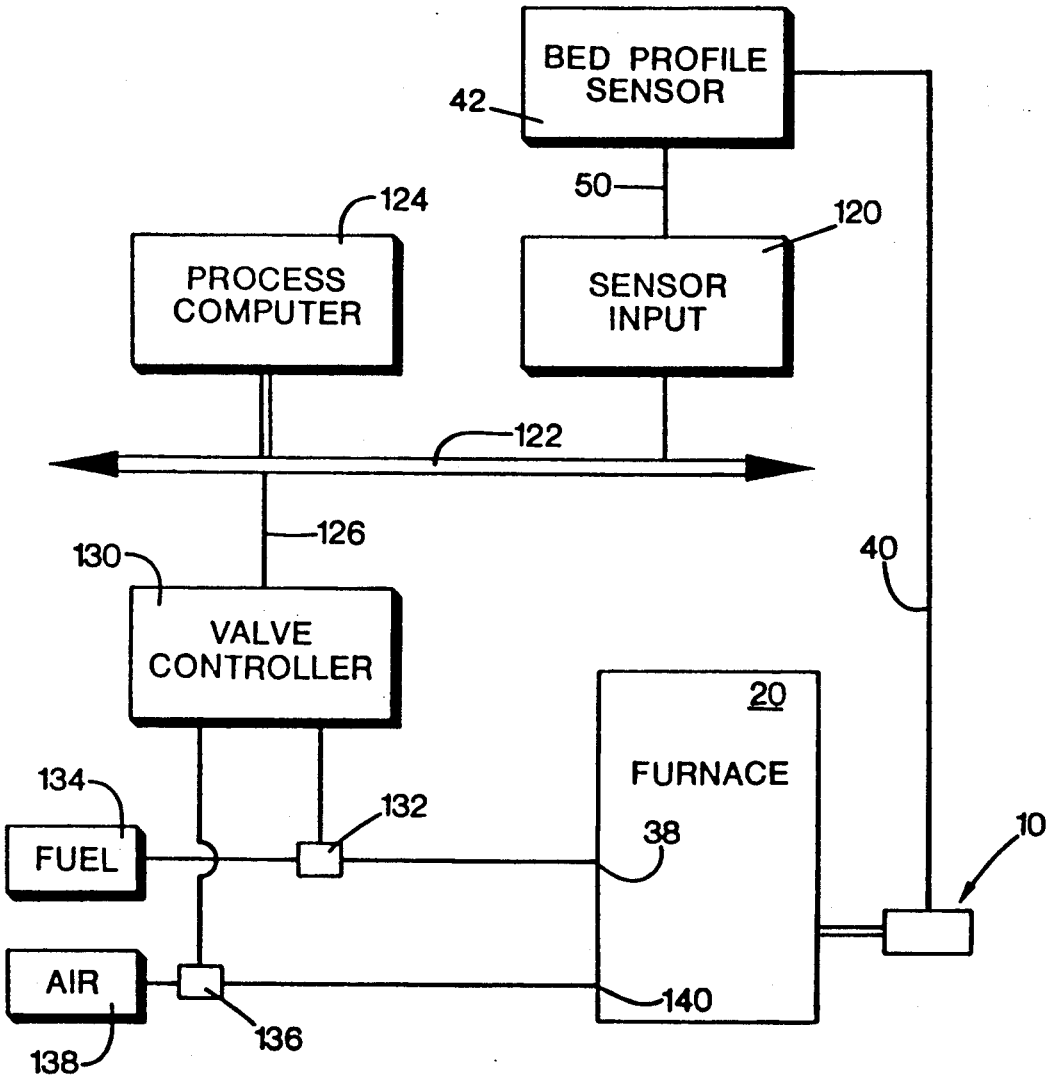
FIG. 11 is a schematic illustration of a boiler system including a bed profile determining subsystem in accordance with the present invention.

Referring to FIG. 11, the bed profile imaging system, designated as a bed profile sensor 42 in FIG. 11, is shown for use in the control of a furnace either indirectly, through operator entered commands via interface 48 in FIG. 1, or directly and automatically. In either case, command signals may be transmitted on line 50 and through a conventional sensor interface 120 to a data bus 122 and thus to a conventional process computer 124 used in the control of the furnace. The process computer is typically coupled by the bus 122 and a control line 126 (and via another interface not shown) to a valve controller 130. The valve controller typically controls plural valves (one being indicated at 132 in FIG. 11) for controlling the flow of fuel from a source 134 to fuel nozzles, such as 38. Similarly, various combustion air valves or dampers 136 are controlled by valve controller 130 to control the flow of combustion air from a source 138 (e.g. a fan or blower) to the various ports (e g. port 140 in FIG. 11) of the furnace.

In a conventional smelt bed boiler, combustion air flow may be controlled between primary, secondary and sometimes tertiary ports to achieve a vertical air flow balance. In addition, air flow may be controlled to the various ports at each level individually to achieve a horizontal balance, with more or less air being supplied to various ports depending upon the performance of the furnace. In addition, the air flow may be controlled to achieve an overall balance in the system. In general, a number of parameters affect the performance of a furnace. In particular, a decrease in bed volume typically may be achieved by increasing the air-to-fuel ratio. In addition, to decrease the height of the bed, the floor of combustion air directed toward the upper sections of the bed may be increased. Conversely, to increase the height of the bed, the air supply to the upper region of the bed, e.g. by way of the tertiary ports, may be reduced. Similarly, the slope of the bed may be varied by increasing or decreasing the air supplied to the respective lower and upper portions of the bed. That is, by decreasing the flow of air to a lower portion of the bed, the slope of the bed tends to flatten as combustion is typically reduced at such bed locations. Similarly, if a bed becomes tilted to one side, as would be apparent from the determined bed profile, combustion can be adjusted by altering the air supply to the respective sides of the bed to thereby adjust the contour of the bed.

Typically, an experienced boiler operator may observe the determined profile and, in response thereto, adjust the parameters affecting furnace performance to change the operating conditions of the furnace and thus the configuration of the actual bed. The determined bed profile will in turn be adjusted over time and the display of the adjusted determined bed profile will provide the operator with a confirmation of the success of the steps taken by the operator. In addition, by displaying a target bed profile along with the determined bed profile, an operator has immediate visual feedback as to a comparison between the determined profile and target profile so that the operator can readily determine differences or deviations from the desired result. Similarly, comparisons between target bed characteristics such as height, volume and slope may be displayed and compared with the corresponding determined bed characteristics. Furthermore, the imaging system 42 (FIG. 1) may issue or produce an indicator signal in the event the difference between the target bed characteristic and the determined bed characteristic exceeds a threshold. For example, if the determined height of the bed exceeds the target height of the bed by a predetermined amount, for example about 20 percent, the indicator signal may be produced. The indicator signal may be fed to a visual indicator, such as an LED display. Alternatively, or in combination therewith, the indicator signal may be fed to an auditory indicator, such as an alarm. The visual and auditory indicators are activated to provide the operator with further information concerning the existence of undesirable conditions in the furnace.

Figure 12:
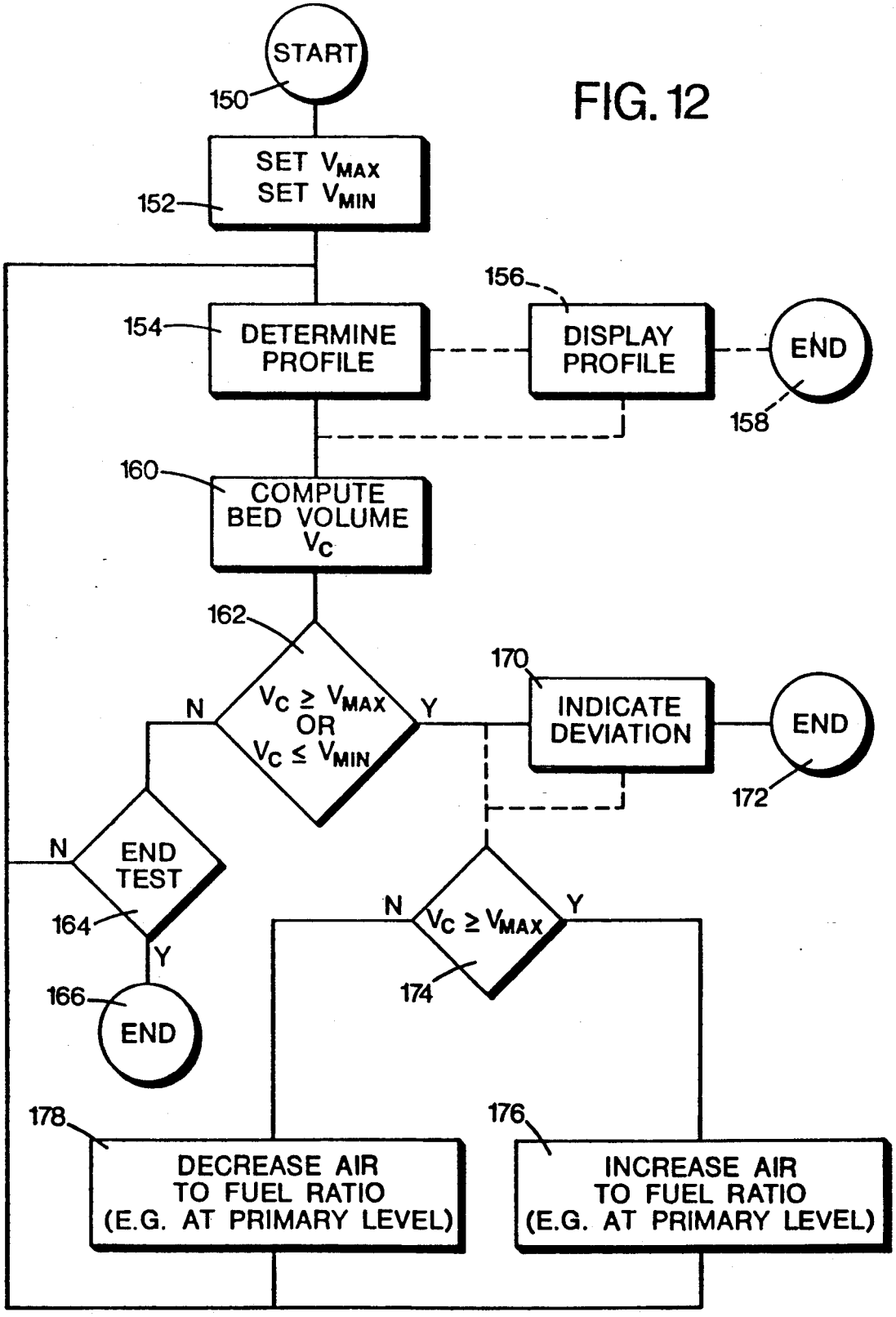
FIG. 12 is flow chart illustrating the use of the determined bed profile information in determining the volume characteristic of the bed and optionally in the control of the furnace in response to the determined bed volume.
Figure 13:
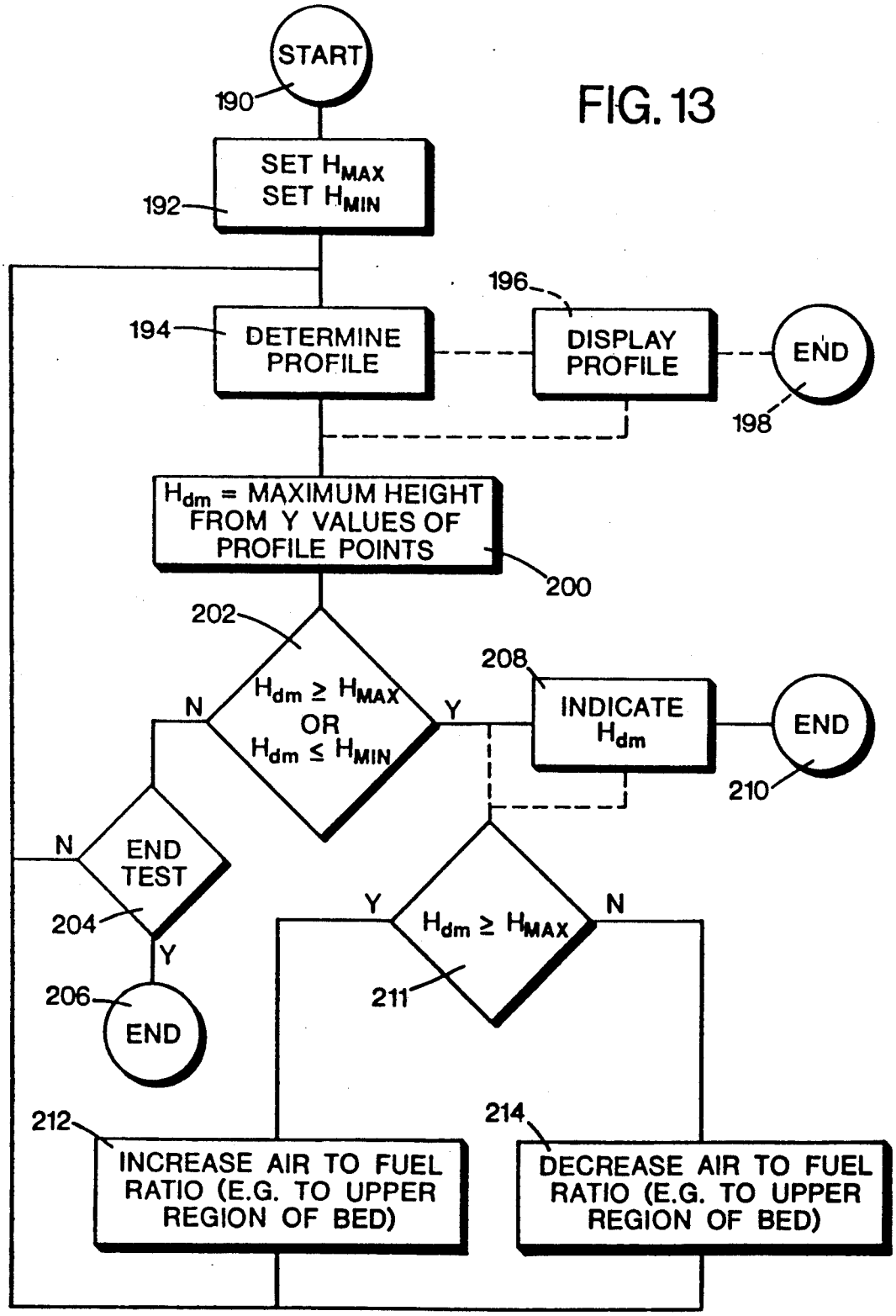
FIG. 13 is a flow chart illustrating the use of the determined bed profile information in determining the height characteristic of the bed and the optional use of the determined height information in the control of the operation of the furnace.
Figure 14:
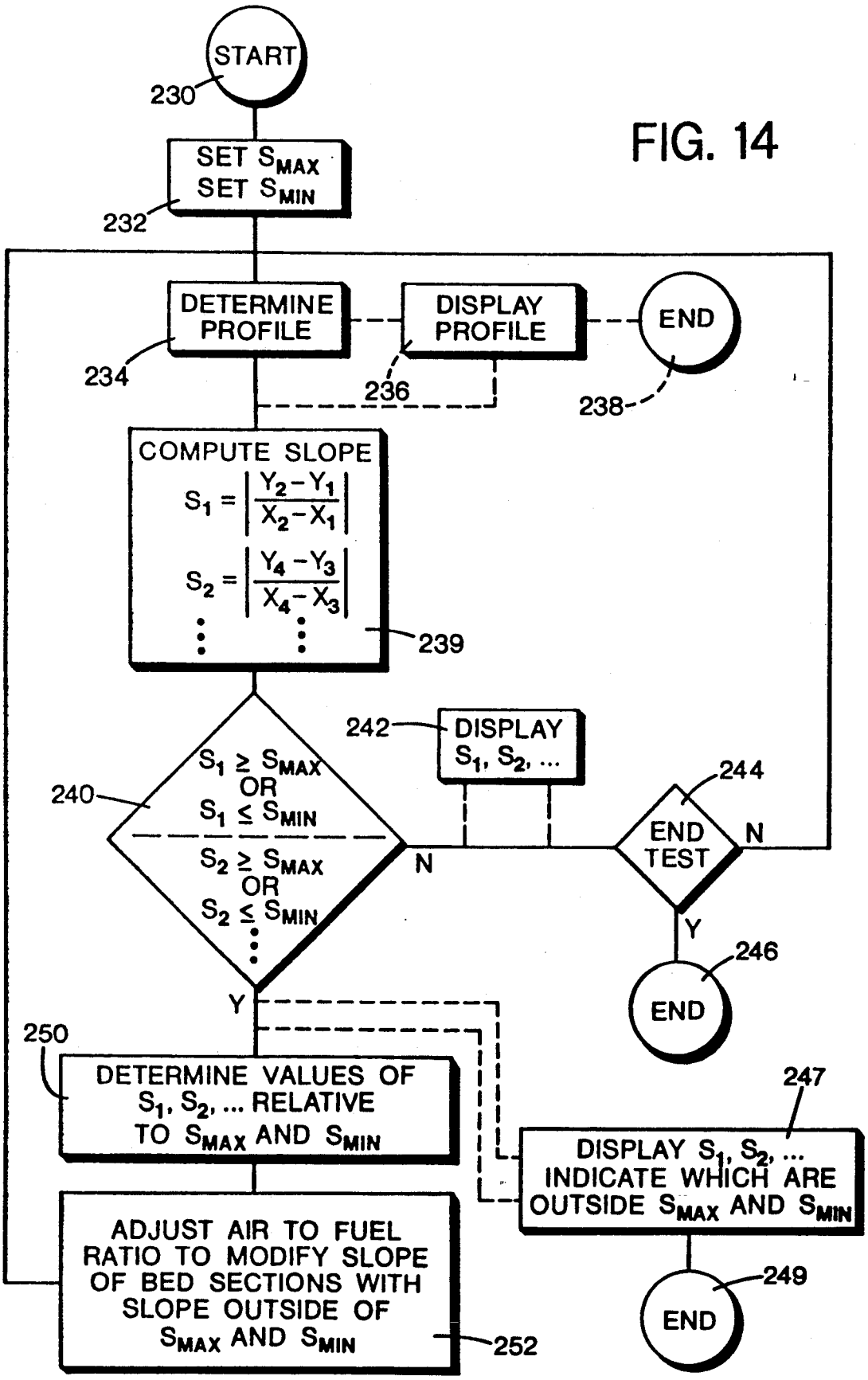
FIG. 14 is a flow chart illustrating the use of the determined profile information in obtaining the slope characteristic of the bed and optionally in using such determined slope characteristic in controlling the operation of the furnace.

FIGS. 12, 13 and 14 illustrate exemplary flow charts used in imaging system 42 for processing the determined profile information.

With reference to FIG. 12, this flow chart relates to the display of information concerning the volume of the bed in controlling the operation of the furnace. The flow chart starts at block 50 and then reaches a block 152 at which a maximum target volume Vmax and minimum target volume Vmin values are set. That is, at block 152, target maximum and minimum volumes are established for use by the system. At block 154, the profile of the bed is determined as explained previously in connection with FIG. 6. The determined profile may be displayed at block 156 with the process ending at a block 158 as shown in this figure (or returning to block 154 for continued processing). Alternatively, from block 156, or directly from the block 154, a block 160 is reached. At block 160, the bed volume is computed, for example using the circular or elliptical approximation techniques previously explained. The computed volume Vc is then compared at block 162 with the Vmax and Vmin volumes. If Vc is greater than or equal to Vmax or Vc is less than or equal to Vmin, a determination has been made that Vc, the computed volume, is outside of the target volume set at block 152. Otherwise, the computed volume is within the target and a branch is followed to a block 164. At block 164 a determination is made as to whether the testing is finished, in which case an end block 166 is reached. If testing is not complete, from block 164 the determined profile block 154 is again reached and the process continues.

If the computed volume Vc is outside of the target volume at block 162, a block 170 may be reached with the deviation being indicated and/or displayed, followed by an end block 172 (or a return to block 154 for continued processing). Instead of reaching block 170 or, alternatively, from block 170, a decision block 174 may be reached. At block 174 a determination is made as to whether the computed volume is greater than or equal to Vmax, the maximum target volume. If the answer is yes, a block 176 is reached. At block 176, the combustion airto-fuel ratio is increased, e.g. additional air is added to the primary port level of the furnace, to decrease the bed size. If at block 174 a determination is made the Vc, the computed volume, is not greater than or equal to Vmin then Vc must be less than or equal to Vmin at this point in the process. In this case, a block 178 is reached and the air-to-fuel ratio is decreased, e.g. at the primary port level. From blocks 176 and 178, the block 154 is again reached and a determination of the bed profile continues. Of course, other techniques for utilizing the computed bed volume information may also be used and would be apparent to those of ordinary skill in the art.

FIG. 13 illustrates a flow chart for utilizing the height characteristic of the bed, such as derived from the determined bed profile. At block 190, the process begins and continues to a block 192 at which time a maximum target height Hmax and a minimum target height Hmin is set, for example by the user utilizing interface 48 in FIG. 1. From block 192, a block 194 is reached and the profile of the bed is determined in accordance with the flow chart of FIG. 6 as previously explained. From block 194, a block 196 may be reached with the profile being displayed and the process ending at a block 198 (or returning to block 194 for further bed profile determinations). From block 196, or alternatively from block 194, a block 200 is be reached. At block 200, the height of the bed is derived from the determined bed profile. The height Hdm may be determined from the Y values of the profile points as shown in FIG. 7. From block 200, a block 202 is reached at which time a determination is made as to whether the maximum determined height Hdm is greater than or equal to the maximum target height Hmax or less than or equal to the minimum target height Hmin. If the answer is no, a block 204 is reached at which time a determination is made as to whether the test is over. If testing is over, an end block 206 is reached. If not, the process returns to the determined profile block 194 and the next determination of a bed profile is made.

If at block 202 a determination is made that the determined height Hdm is outside of the target maximum and minimum heights (Hmax and Hmin), a block 208 may be reached, at which time the computed height Hdm is indicated or displayed and the process ends at block 210 (or continues to block 194 for further processing). Instead of reaching block 208, or from block 208, a block 211 may be reached. At block 211, a determination is made as to whether the computed height Hdm is greater than or equal to the maximum target height Hmax. If the answer is yes, the air-to-fuel ratio may be increased, (e.g. to the upper region of the bed), to cause a greater fuel consumption at such region and to thereby reduce the bed height. If at block 211, a determination is made that Hdm is not greater than or equal to Hmax, then Hdm must be less than or equal to Hmin at this point in the flow chart. In this case, from block 211, a block 214 is reached and the air-to-fuel ratio is decreased (e.g. at the upper region of the bed). As a result, the height of the bed is increased. In this manner, by adjusting the air-to-fuel ratio, or other parameters furnace operation as would be known to the operator of the furnace, the maximum bed height may be adjusted to more closely match the target height. From blocks 212 and 214, the process returns to block 194 and a determination of the bed profile continues.

The flow chart of FIG. 14 illustrates one approach for using the slope characteristics of the bed. In accordance with FIG. 14, from a start block 230, a block 232 is reached at which time a maximum slope Smax and minimum slope Smin is established. Smax and Smin may be established by the operator utilizing interface 48 and is typically of the greatest concern for Gotaverken-type boilers. From block 232, a block 234 is reached and the profile of the bed is determined, for example in accordance with FIG. 6 as previously explained. From block 234, the profile may be displayed at a block 236 with the process ending at a block 238 (or continuing to block 234). From block 236, or alternatively from block 234, a block 239 may be reached. At block 239, the magnitude of the slope at various portions of the bed is determined. For example, with reference to FIG. 7, two slope computations, namely for slopes S1 and S2, are indicated at block 239. The slope may be computed at various locations along the determined bed profile in this manner. From block 239, at a block 240, a determination is made as to whether the computed slopes are greater than or equal to the maximum slope Smax or less than or equal to the minimum slope Smin. It should be noted, of course, that Smax and Smin may be varied so as to be different for the various locations along the bed profile. From block 240, the various slopes may be displayed, as indicated at block 242 and the testing ended at blocks 244 and 246 if the testing is complete at this point. If testing is not complete at block 244, the process may continue at the determined profile block 234. Alternatively, or in addition to displaying the resulting slopes and following the branch through blocks 242, 244, etc., from block 240, a block 250 and/or a block 247 is reached. At block 247, this relationship between the computed slopes and target slopes (e.g. Smax and Smin) is displayed. From block 247, an end block 249 may be reached or the process may be continued to block 234 or block 250. At block 250, the values of the slopes S1, S2, and any other computed slopes for other locations, are compared to the target Smax and Smin values for the locations where the slopes have been determined.

In addition, at block 240 or at block 250, the operator may be alerted, as by a visual display or auditory alarm, that slopes are present which deviate from the target slopes. From block 250, a block 252, is reached. At block 252 the parameters of the furnace are adjusted to adjust the determined slopes to more closely match the target slopes Smax, Smin. In general, at block 252, the air-to-fuel ratio may be increased to those sections of the bed associated with a slope which is less than or equal to Smin to steepen the slope at such points. Conversely, the air-to-fuel ratio may be decreased at such locations where the slope is too steep to decrease the slope at such locations. Again, in a conventional boiler, the air supply at various levels in the boiler is controllable in a conventional manner and such controls may be utilized to adjust the bed configuration as a result of the determined bed profile or other bed characteristics. From block 252, the flow chart returns to block 234 and the process of determinating the bed profile continues.

Having illustrated and described the principles of our invention with reference to several preferred embodiments, it should be apparent to those of ordinary skill in the art that this invention may be modified in arrangement and detail without departing from such principles. For example, the image processing techniques for determining transitions in the bed profile may be modified with the goal being to enhance the determination of transitions, and thus the determined bed profile relative to the actual bed profile. In addition, the flow charts relating to the use of the bed characteristics, such as the derived or determined bed profile, the bed height, bed slope, and bed volume may be modified as suitable for the particular furnace of interest and for compatibility with the procedures adopted by the operators of such furnaces. We claim as our invention all such modifications as fall within the scope of the following claims.

We claim:

1. A method for profiling the bed of a furnace surrounded by a background comprising walls of the furnace, the method comprising:

producing plural digital images of the bed and background;

processing images to determine transitions of the image which correspond to transitions between the bed and background and thereby to the boundary of the bed;

the processing step comprising the steps of selecting images from the plural digital images for clarity, temporally averaging the selected images, differentiating the temporally averaged images, smoothing the images following differentiation; and locating transitions in the differentiated images, the transitions corresponding to transitions between the bed and background and thereby to the boundary of the bed; and determining at least one bed characteristic from the processed image, the characteristic being selected from the group comprising the bed profile, the bed height, the slope of the bed and the volume of the bed.

2. A method according to claim 1 in which the step of locating transitions comprises the step of performing a continuity check by selecting transitions which yield a substantially continuous or smoothly determined boundary of the bed.

3. A method according to claim 2 in which the step of locating transitions also comprises the step of performing a region growing process.

4. A method according to claim 1 in which the step of locating transitions comprises the step of performing a region growing process to locate transitions.

5. A method according to claim 1 in which the determining step comprises the step of determining the bed volume.

6. A method according to claim 5 in which the step of producing digital images comprises the step of producing digital image frames corresponding to a twodimensional image of the bed taken from a first direction, and in which the step of computing the bed volume comprises the step of computing the bed volume utilizing a circular approximation for the configuration of the bed.

7. A method according to claim 5 in which the step of producing digital images comprises the step of producing first digital image frames corresponding to twodimensional images of the bed and background taken in a first direction and the step of producing second digital image frames corresponding to two-dimensional images of the bed and background taken in a second direction at an angle relative to the first direction, and in which the step of computing the bed volume comprises the step of computing the bed volume using an elliptical approximation for the configuration of the bed.

8. A method according to claim 1 comprising the step of providing a reference bed characteristic;

comparing the determined bed characteristic with the reference bed characteristic; and activating an indicator in the event the reference and determined bed characteristics differ by a threshold amount.

9. A method according to claim 8 including the step of controlling the operation of the furnace to adjust the bed characteristic.

10. A method according to claim 1 comprising the step of providing a reference bed characteristic;

comparing the determined bed characteristic with the reference bed characteristic; and controlling the operation of the furnace to adjust the bed characteristic.

11. An apparatus for profiling the bed of a furnace surrounded by a background comprising walls of the furnace, the apparatus comprising:

imaging means disposed proximate to a region of the bed to be monitored for producing an image signal corresponding to an image of the monitored portion of the bed and background;

signal processing means connected to the imaging means for processing the image signal to determine transitions in the image corresponding to transitions between the bed and background and thereby to the boundary of the bed;

the signal processing means includes means for determining at least one bed characteristic from the processed image, the characteristic being selected from the group comprising the bed profile, the bed height, the slope of the bed and the volume of the bed;

the imaging means comprising means for producing plural digital image of the bed and background, the signal processing means comprising means for selecting images from such plural images on the basis of the clarity of the images, the signal processing means comprising means for temporally averaging, differentiating and smoothing the selected images, and the signal processing means comprising means for locating transitions in the differentiated images, such transitions corresponding to transitions between the bed and background and thereby to the boundary of the bed.

12. An apparatus according to claim 11 in which the signal processing means includes means for performing a continuity check of the differential images to locate the transitions.

13. An apparatus according to claim 15 in which the signal processing means comprises a means for applying region growing process to the differentiated images so as to locate the transitions.

14. An apparatus according to claim 11 in which the signal processing means comprises means for applying region growing process to the differentiated images so as to locate the transitions.

15. An apparatus for profiling the bed of a furnace surrounded by a background comprising walls of the furnace, the apparatus comprising:

imaging means disposed proximate to a region of the bed to be monitored for producing an image signal corresponding to an image of the monitored portion of the bed and background, signal processing means connected to the imaging means for processing the image signal to determine transitions in the image corresponding to transitions between the bed and background and thereby to the boundary of the bed;

the signal processing means including means for determining at least one bed characteristic from the processed image, the characteristic being selected from the group comprising the bed profile, the bed height, the slope of the bed and the volume of the bed;

the imaging means comprising an image sensor disposed outside of the furnace and positioned to view a portion of the bed through a port formed in a wall of the furnace, the imaging sensor producing an image signal corresponding to the image of the background interior walls of the furnace and of the bed in the region of interest, the bed and background appearing as areas of contrast in the image;

the imaging apparatus also including an image digitizer connected to the imaging sensor and operated to produce a digital signal from the image signal, the digital signal corresponding to a two-dimensional representation of the image;

the signal processing means being connected to the image digitizer for receiving the digital signal and for processing the digital signal to determine transitions in the image corresponding to transitions between the bed and background and thereby to the boundary of the bed;

the signal processing means comprising means for determining the volume of the portion of the bed represented by the image signal utilizing a circular approximation for the bed configuration;

the apparatus including first and second imaging sensors each disposed outside of the furnace and positioned to view respective portions of the bed through respective ports formed in a wall of the furnace, the first imaging sensor being focused in a first direction toward the bed for producing an image signal corresponding to the image of the bed and the background interior walls of the furnace in a first region of interest, the second imaging sensor being focused on the bed in a second direction to an angle to the first direction for producing an image signal corresponding to the image of the bed and background interior walls of the furnace in a second region of interest, the bed and background appearing in the images as areas of contrast;

the image digitizer comprising means connected to each of the imaging sensors for producing a first digital signal corresponding to a two-dimensional representation of the image signal from the first imaging sensor and second digital signal corresponding to a two-dimensional representation of the image signal from the second imaging sensor;

the signal processing means being connected to the image digitizer for receiving the first and second digital signals, and the signal processing means comprising means for determining the volume of the portion of the bed represented by the image signals utilizing an elliptical approximation for the bed configuration.

* * * * *

UNITED STATES PATENT AND TRADEMARK OFFICE

CERTIFICATE OF CORRECTION

PATENT NO. : 5,139,412

DATED : August 18, 1992

INVENTOR(S) : Kychakoff et al.

It is certified that error appears in the above-identified patent and that said Letters Patent is hereby corrected as shown below:

Column 8, line 67
should read --|M|--.

Column 16, line 53
"includes" should read --including--.

Column 17, line
"differential" should read --differentiated--.

Column 17, line 7
15" should read --claim 12--.

Signed and Sealed this

Thirtieth Day of May, 1995

Bruce Lehman

BRUCE LEHMAN

*Commissioner of Patents and Trademarks*

*Attest:*

*Attesting Officer*